US005154354A

United States Patent [19]

Reiter

[11] Patent Number: 5,154,354

[45] Date of Patent: Oct. 13, 1992

[54] DEVICE FOR THE PRODUCTION OF A PROTECTIVE GAS MANTLE IN PLASMA SPRAYING

[75] Inventor: Christian Reiter, Solothurn, Switzerland

[73] Assignee: Nova-Werke AG, Effretikon, Switzerland

[21] Appl. No.: 818,400

[22] Filed: Jan. 2, 1992

Related U.S. Application Data

[63] Continuation of Ser. No. 423,434, filed as PCT/CH89/00009, Jan. 13, 1989, abandoned.

[30] Foreign Application Priority Data

Feb. 1, 1988 [CH] Switzerland ..... 00340/88

[51] Int. Cl.[5] ..... B05B 1/28

[52] U.S. Cl. ..... 239/299; 239/290

[58] Field of Search ..... 239/85, 290, 299

[56] References Cited

U.S. PATENT DOCUMENTS 3,470,347 9/1969 Jackson .
3,526,362 9/1970 Jackson ..... 239/290 X
4,097,872 6/1978 Giordano et al. ..... 239/299 X
4,634,611 1/1987 Browning ..... 239/290 X
4,836,447 6/1989 Browning ..... 239/85 X
4,869,936 9/1989 Moskowitz et al. ..... 239/290 X

FOREIGN PATENT DOCUMENTS 2818303 11/1978 Fed. Rep. of Germany .

*Primary Examiner*—Andres Kashnikow
*Assistant Examiner*—William Grant
*Attorney, Agent, or Firm*—Tarolli, Sundheim & Covell

[57] ABSTRACT

A protective gas nozzle (6) and a gas feed channel (10) for the protective gas is arranged concentric around a spray jet nozzle (5). The protective gas nozzle (6) has a core hollow space (26) with a curved closing surface (9) at the rear end (8) of the nozzle (6). With this, the protective gas nozzle (6) with the gas feed channel (10) and the wall (13) lying opposite forms a nozzle channel (14) which at first extends radial and then about parallel between the gas feed channel (10) and the core hollow space (26).

5 Claims, 2 Drawing Sheets

DEVICE FOR THE PRODUCTION OF A PROTECTIVE GAS MANTLE IN PLASMA SPRAYING

This is a continuation of copending application Ser. No. 07/423,434 filed on Sep. 25, 1989, now abandoned International Application CH89/0009 filed on Jan. 13, 1989 and which designated the U.S.

TECHNICAL FIELD

The invention relates to a device for the production of a protective gas mantle in the plasma spraying of coating materials including a device for producing the plasma jet, feeds for the coating material, a spray jet nozzle, and a gas feed channel for protective gas arranged concentric around the spray jet nozzle.

BACKGROUND ART

Devices of this kind are used as nozzles or spray guns in plasma spraying devices. The plasma is produced in the known way, for example, through an electric light arc and a carrying gas. Atomized or powder-form coating materials are introduced into the hot plasma. The resultant plasma jet is directed through a spray jet nozzle onto the workpiece to be coated. Such a nozzle is known from U.S. Pat. No. 3,470,347. Here, a ring-shaped protective gas feed channel is arranged around a spray jet nozzle. This protective gas feed channel is open in the direction of the spray jet and the stream of protective gas is intended to enclose in a ring shape the spray jet lying in the center. Another such device is known from German Disclosure No. 2,818,303. In this device, a protective gas feed channel is also in a ring shape and is arranged concentrically around a spray jet nozzle. However, the outflow direction of the protective gas is directed opposite the flow direction of the spray jet. This leads to flow conditions hard to control between the protective gas and the spray jet.

In the devices described and others for plasma spraying, difficulties occur from time to time since the spray jet coming out of the nozzle is disturbed by various influences. Danger exists in that, through eddying, surrounding air will penetrate into the spray jet. As a result, parts of the coating material will be oxidized. This leads to an unsatisfactory quality of coating. Uncontrolled flow conditions between the protective gas mantle and the spray jet lead to affecting the shape of the spray jet. This may cool off the particles of coating material at the outer portion of the spray jet until it also leads to an adverse effect on the quality of the coating. Since the coating materials are available today, also in powder form, in high purity and in the desired composition, the disturbing influences described, even if they occur only in a slight degree, lead to an undesirable decrease of quality of the coatings.

SUMMARY OF THE INVENTION

The problem of the present invention is to provide a device for the production of a protective gas mantle around a spray jet, which prevents eddying at the surface of the spray jet and completely keeps away from the spray jet the surrounding air between the spray nozzle and the workpiece to be coated. Moreover, the undesirable cooling of the outer portion of the spray jet should be prevented, and controlled flow conditions between the protective gas mantle and spray jet should be provided.

This problem is solved by the fact that there is connected to a gas feed channel a protective gas nozzle with a hollow space at the core. The diameter and length of the core hollow space of the protective gas nozzle is, in each case, at least as great as the outlet diameter of the spray nozzle. This core hollow space, at the front end in the flow direction of the plasma jet, is open over the entire cross-sectional area of the protective gas and plasma jet. The core hollow space and thus the protective gas nozzle has a shut-off surface at the rear end in the flow direction of the plasma jet. The shut-off surface is ring-shaped and rotation-symmetrical with the lengthwise axis and is at least partly curved or beveled. The gas feed channel is arranged at the rear end of the protective gas nozzle in the flow direction of the plasma jet. The ring-shaped shut-off surface of the protective gas nozzle is connected, on one hand, with the outlet edge portion of the spray nozzle. On the other hand, the ring-shaped shut-off surface forms with the wall of the gas feed channel lying opposite a nozzle channel which has, in a section plane running through the axis, diverging cross-sectional areas.

One preferred embodiment of the invention is distinguished by the fact that the nozzle channel formed by the shut-off area of the protective gas nozzle and the gas feed channel runs in the flow direction of the protective gas. It is run at first radially and about perpendicular to the lengthwise axis of the protective gas nozzle, and then continuously or in steps, is turned into the flow direction of the plasma jet.

In another embodiment, the shut-off area of the protective gas nozzle has, in the portion of the outlet edge of the spray nozzle, an angle of 0° to 60° from the longitudinal axis of the nozzle. The angle in this portion is inclined against the flow direction of the plasma jet. Another improvement of this device is obtained by the fact that on the nozzle channel, the cross sections perpendicular to the flow direction of the protective gas are of equal size independent of the radial distance to the nozzle axis. In another preferred embodiment, a ring-shaped expansion channel is arranged before the gas feed channel.

According to the invention in a spray nozzle or spray gun designed in the known way, the protective gas nozzle with a core hollow space is arranged concentrically around the spray jet nozzle or plasma jet. The protective gas nozzle has, in relation to the outlet diameter of the spray jet nozzle, definite minimum dimensions and a specially formed rear shut-off area. The protective gas is first introduced into a ring-shaped expansion channel and flows through a gas feed channel also ring-shaped into the nozzle channel. This nozzle channel is at first directed radially and about perpendicular to the central axis of the protective gas nozzle. In the flow direction of the protective gas, that is, from the expansion channel in the direction of the spray jet nozzle, the nozzle channel is then turned, continuously or in steps, into the flow direction of the spray jet nozzle or plasma jet. Through this turning of the channel, the protective gas is turned in the same direction as the spray jet. Through this turning, the protective gas layers of the protective gas mantle, which are directed finally against the spray jet, are greatly accelerated and laid free of eddies against the outer portions of the spray jet. During the inflow of the protective gas from the outside inward to the spray jet, the protective gas is heated while the temperature of the protective gas can be regulated by known cooling devices. The protected gas used may be any of the known gasses. The choice may be directed, also in the known way, according to the coating material used and the addition criteria known in plasma spraying.

The advantages of the device according to the invention lie in the fact that through the design according to the invention, the protective gas mantle has no disturbing effects on the spray jet. In particular, its outer portion is not eddied and cooled. Through the freedom from eddies, the protective gas stream is also heated less and it may be used more strongly for the cooling of the coated surface. This often makes possible a reduction of the amount of protective gas, which leads to savings. Moreover, the uniform and controlled flow of the protective gas mantle hinders the entrance of surrounding air to the spray jet, whereby very high qualities of coating can be obtained.

BRIEF DESCRIPTION OF THE DRAWINGS

The invention will be explained below from examples of embodiments with reference to the attached drawings.

DETAILED DESCRIPTION OF PREFERRED EMBODIMENTS

Figure 1:
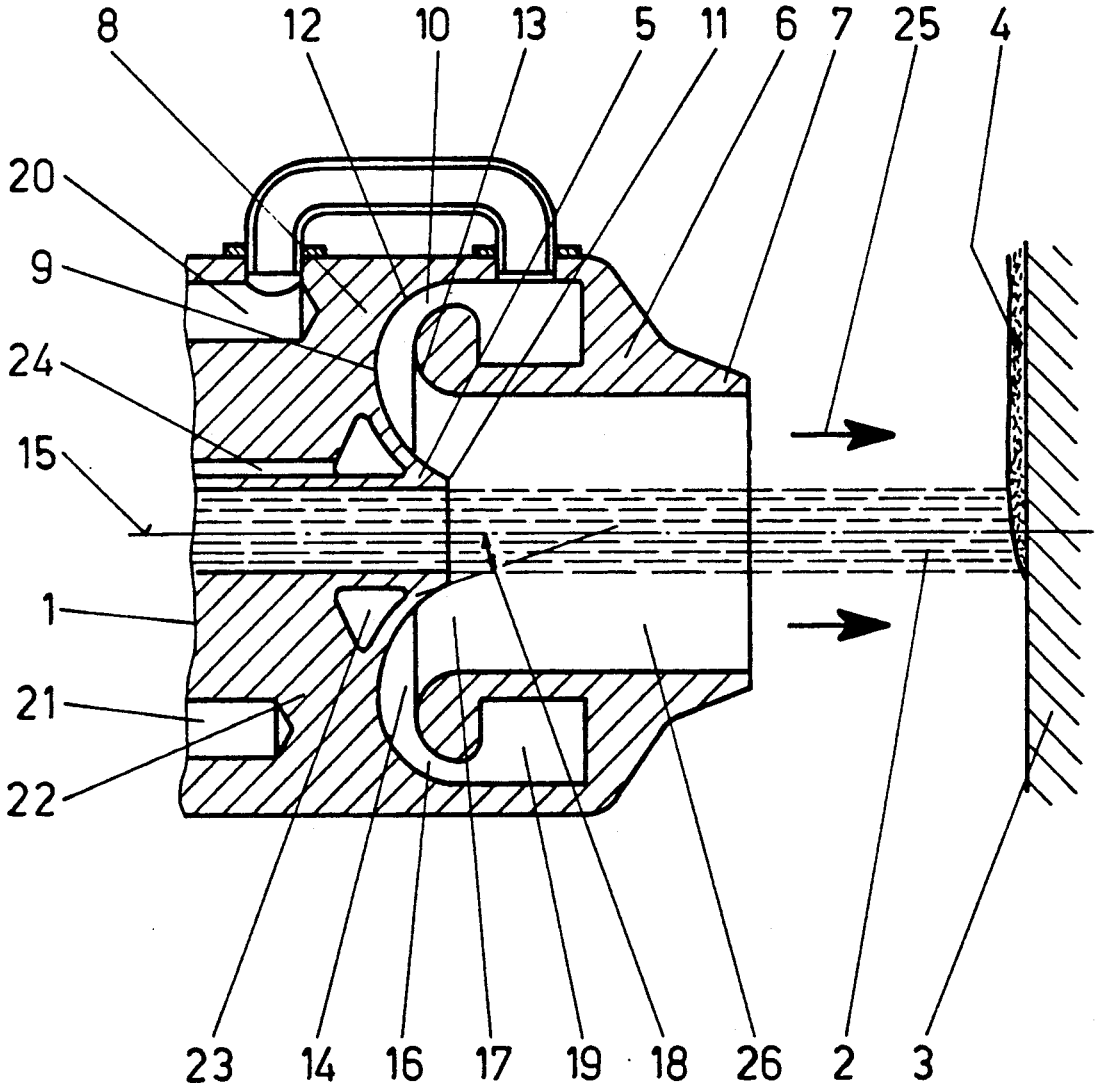
FIG. 1 shows in diagram a section through the front part of a plasma spray gun constructed according to the invention with a protective gas nozzle.

A front part 1, represented in FIG. 1, of a plasma spray gun is built onto a plasma spray gun or plasma spray device of the known kind. The known devices for the forming of a plasma jet 2 which consists of a carrier gas and the melted coating material, as well as the feeds for the coating material, are not shown. A protective gas nozzle 6 is arranged concentric around a spray jet nozzle 5. The protective gas nozzle 6 extends, in the flow direction 25 of the plasma jet 2, beyond an outlet edge portion 11 of the spray jet nozzle 5. The protective gas nozzle 6 consists mainly of a core hollow space 26 through which flows the plasma jet 2 and the protective gas stream surrounding it, a ring-shaped expansion channel 19, a gas feed channel 10 for the protective gas, and a shut-off surface 9. The shut-off surface 9 forms a wall of a nozzle channel 14. In the example shown, the diameter of the core hollow space 26 determines the width of the flow channel into the nozzle 6 and is about 2.5 times as great as the outlet diameter of the spray jet nozzle 5 in the outlet edge portion 11. The length of the protective gas nozzle 6 is measured from the rear-most point of the shut-off area 9 to the outlet edge of the core hollow space 26 at the front end 7. In the example shown, the length of the protective gas nozzle 6 is greater than the outlet diameter of the spray jet nozzle 5 by a factor of approximately five. The shut-off area 9 is a rotation-symmetrical ring surface curved in the direction of the rear end 8 of the protective gas nozzle 6. The shut-off area 9 closes, on the one hand, against the outlet edge portion 11 of the spray jet nozzle 5 and, on the other hand, is connected at its outer portion to the rear wall 12 of the gas feed channel 10. With a wall 13 lying opposite of the gas feed channel 10, the wall 12 and the shut-off area 9 form the limiting surfaces for the nozzle channel 14. If an intersection surface is laid through the axis 15, the cross-sectional area of the nozzle channel 14 which lies in this intersection surface has a cross-section diverging from a beginning portion 16 toward an end portion 17.

In the example shown, the protective gas used is argon which is fed to the protective gas nozzle 6 through a feed line 20. This feed line 20 discharges into a ring-shaped expansion channel 19 arranged concentric around the axis 15. In this expansion channel 19, the protective gas is distributed evenly over the whole circumference, and flows then through the gas feed channel 10 also ring-shaped into the nozzle channel 14 and from here, parallel with the plasma jet 2, through the core hollow space 26 toward the workpiece 3. The arrangement of the gas feed channel 10 forces the stream of protective gas to flow at first radially in relation to the axis 15 and the plasma jet 2, respectively. In the further course of flow, the protective gas stream is turned in the direction of the flow 25 of the plasma jet 2, while in the whole portion of the closing area 9 a component radial to the axis is retained. Through this conduction of the protective gas stream, the outer layers of the protective gas stream along with the closing area 9 are considerably accelerated. Through the simultaneous heating of the protective gas stream, the protective gas expands and the stream of protective gas is additionally accelerated. As a result of this special flow conduction, the stream of protective gas lies practically free of turbulence against the outer surface of the plasma jet 2. The eddying of the outer portion is prevented. With this arrangement in the flow channel 26 and in the portion which follows between the front end 7 of the protective gas nozzle 6 and the workpiece 3, there is no mixing between the protective gas mantle stream and the plasma spray jet 2. No surrounding air which might penetrate into the protective gas mantle stream can reach the outer portion of the plasma jet 2. In this way, an extremely high quality of coating 4 on the workpiece 3 can be attained, which is not influenced by the surrounding air and has no harmful components.

In the spray jet nozzle 5 are arranged cooling channels 23, 24 which protect the spray jet nozzle 5 from overheating. The coolant is fed to these cooling channels 23, 24 through the feed line 21 and the coolant channel 22. By means of suitable coolant conduction in the channel 23 and by varying the amount of gas, the temperature of the protective gas in the nozzle channel 14 can be varied. Depending upon the shape of plasma jet 2 desired, the closing area 9 is given a definite angle 18 in the portion of the outlet edge 11 on the spray jet nozzle 5. In the example shown, this angle 18 is about 20°. In the nozzle channel 14, the ring-shaped cross-sectional areas in the flow of direction of the protective gas can be reflected and are in each case perpendicular to the flow direction. This plurality of cross-sectional areas has the same size ring surface independent of the distance from the axis 15. Starting from this premise, there is given in the example shown also the uniform funnel shape of the nozzle channel 14.

Figure 2:
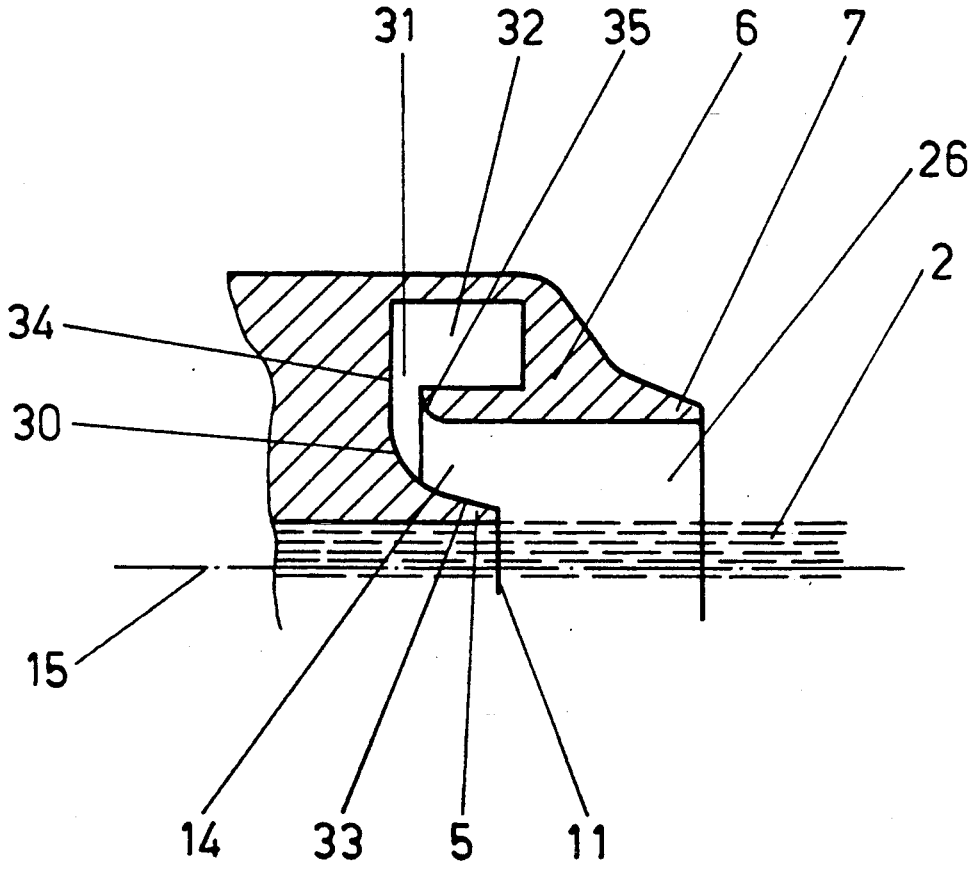
FIG. 2 shows in partial section a protective gas nozzle with a diagonal closing surface.

FIG. 2 shows a simplified design of a closing area 30 and a gas feed channel 31. The feed line for the protective gas and the coolant channel are designed in the same way as in FIG. 1 and described, but not shown in FIG. 2 for simplicity. The protective gas fed through the feed line, not shown, is again distributed in an expansion channel 32 around the whole circumference of the protective gas nozzle 6. The protective gas then flows through the ring-shaped gas feed channel 31 into the nozzle channel 14. The closing surface 30 is closed in a straight line against the outlet edge portion 11 of the spray jet nozzle 5 and forms in this portion a mantle surface 33 of a truncated cone. In its further course, the closing surface 30 is again evenly curved and closes against the rear wall 34 of the gas feed channel 31. An opposite wall 35 and the closing surface 30 form the limiting surfaces for the nozzle channel 14. In this embodiment also, the protective gas is at first conducted radially through the gas feed channel 31 in the direction of the axis 15 and then continuously turned into the direction of flow of the plasma jet 2. Here again, this turning gives the effect already described for FIG. 1 of the acceleration of the protective gas stream and the laying of the protective gas mantle stream, free of turbulence, against the outer portions of the plasma jet 2 in the portion of the core hollow space 26. The choice of the shape of the closing surface 30 as well as the cross-sectional course in the nozzle channel 14 may be adapted, within wide limits, to the parameters of the plasma jet 2, such as flow speed, temperature, composition, etc.

Having described preferred embodiments of the invention, I claim:

1. A device for providing a protective gas mantle around a plasma spray jet (2) directed toward a workpiece (3) to be coated with the plasma spray jet, the device comprising:

a spray jet nozzle (5) through which the plasma spray jet is directed, the spray jet nozzle having an outlet diameter and an outlet edge portion (11);

a protective gas nozzle (6) arranged concentric around the spray jet nozzle and having a lengthwise axis (15) and having a rear end (8) the outlet edge portion of the spray jet nozzle lying in a first plane extending perpendicular to the lengthwise axis;

the protective gas nozzle including a front wall (13, 35) and a rear wall (12, 34) forming a ring-shaped gas feed channel (10, 31) for protective gas, the ring-shaped gas feed channel being located at the rear end of the protective gas nozzle and being arranged concentric around the spray jet nozzle, the front wall lying in a second plane extending perpendicular to the lengthwise axis;

the protective gas nozzle having a core hollow space (26) through which the plasma spray jet and the protective gas flows, the core hollow space having a diameter and a length each of which is at least twice as large as the outlet diameter of the spray jet nozzle, the core hollow space being open at a front end (7) in the flow direction (25) of the plasma spray jet over the entire cross-sectional area of the protective gas and the plasma spray jet;

the protective gas nozzle including a ring-shaped closing surface (9, 30) located at the rear end of the protective gas nozzle, the ring-shaped closing surface being symmetrical about the lengthwise axis and being at least partly curved, the ring-shaped closing surface having an inner side (33) connected with the outlet edge portion of the spray jet nozzle and an outer side connected with the rear wall;

the ring-shaped closing surface lying opposite the front wall and cooperating with the front wall to form a nozzle channel (14) communicating between the ring-shaped gas feed channel and the core hollow space, the nozzle channel having a plurality of ring-shaped cross-sectional areas diverging toward the lengthwise axis, each of the ring-shaped cross-sectional areas lying in an associated plane of intersection extending perpendicular to the lengthwise axis, each of the ring-shaped cross-sectional areas having the same ring surface area independent of the radial distance of the ring-shaped cross-sectional area from the lengthwise axis; and the ring-shaped closing surface lying in a third plane extending perpendicular to the lengthwise axis, the second plane extending between the first plane and the third plane.

2. A device according to claim 1 wherein the nozzle channel (14) extends at first radially in the flow direction of the protective gas and perpendicular to the lengthwise axis (15) and then, at least partly continuously, turns in the flow direction (25) of the plasma spray jet (2).

3. A device according to claim 1 wherein the ring-shaped closing surface (9, 30), in the vicinity of the outlet edge portion (11), forms an angle (18) of 0° to 60° relative to the lengthwise axis (15), the angle being opened against the flow direction (25) of the plasma spray jet (2).

4. A device according to claim 1 further including a ring-shaped expansion channel (19, 32) arranged before the ring-shaped gas feed channel (10, 31).

5. A device according to claim 1 wherein the inner side (33) of the ring-shaped closing surface (30) is oblique relative to the lengthwise axis (15).

* * * * *